US007550049B2

(12) United States Patent
Kula et al.

(10) Patent No.: US 7,550,049 B2
(45) Date of Patent: Jun. 23, 2009

(54) METHOD FOR UNDER-PRESSURE CARBURIZING OF STEEL WORKPIECES

(75) Inventors: Piotr Kula, Lodz (PL); Jozef Olejnik, Swiebodzin (PL); Paul Heilman, Maintul (DE)

(73) Assignees: Seco/Warwick S.A., Swiebodzin (PL); Politechnika Lodzka, Lodz (PL)

( * ) Notice: Subject to any disclaimer, the term of this patent is extended or adjusted under 35 U.S.C. 154(b) by 337 days.

(21) Appl. No.: 10/531,477

(22) PCT Filed: Jul. 2, 2003

(86) PCT No.: PCT/PL03/00065

§ 371 (c)(1),
(2), (4) Date: Apr. 15, 2005

(87) PCT Pub. No.: WO2004/040033

PCT Pub. Date: May 13, 2004

(65) Prior Publication Data

US 2006/0016525 A1 Jan. 26, 2006

(30) Foreign Application Priority Data

Oct. 31, 2002 (PL) ..... 356921

(51) Int. Cl.
*C23C 8/00* (2006.01)

(52) U.S. Cl. ..... 148/218; 148/223

(58) Field of Classification Search ..... 148/223, 148/233, 218

See application file for complete search history.

(56) References Cited

U.S. PATENT DOCUMENTS 4,049,472 A 9/1977 Arndt
4,191,599 A * 3/1980 Stickels et al. ..... 148/233
5,205,873 A 4/1993 Faure et al.
5,702,540 A 12/1997 Kubota
6,187,111 B1 2/2001 Waka et al.

FOREIGN PATENT DOCUMENTS

EP 0545069 B1 6/1993
EP 1160349 B1 12/2001
JP A 11-310865 11/1999

OTHER PUBLICATIONS

Altena, H;"Niederdruck-Aufkohlung Mit Hochdruck-Gasabschreckung Verfahrenstechnik und Ergebnisse," Haerterei Technische Mitteilugen, Carl Hanser Verlag. Munchen, DE, vol. 53, No. 2, pp. 93-101, (Mar. 1, 1998).

* cited by examiner

*Primary Examiner*—George Wyszomierski
*Assistant Examiner*—Weiping Zhu
(74) *Attorney, Agent, or Firm*—Oliff & Berridge, PLC

(57) ABSTRACT

The subject of this invention relates to method carburizing of steel products, mainly parts of machines, vehicles and every mechanical apparatus, in vacuum furnaces under reduced pressure and elevated temperature. The method of under-pressure carburizing of steel workpieces according to present invention relates to introduction of active nitrogen carrier during heating up of the load. Introduction of the active nitrogen carrier is terminated when the load reaches temperature required to start carburizing process; from this temperature the carbon carrier is added. Pressure in the furnace chamber during continuous or pulse introduction of the active nitrogen carrier should be maintained within the ranges from 1 to 500 mbar.

5 Claims, 1 Drawing Sheet

Chart of the metering ammonia in the under-pressure carburizing cycle

Chart of the metering ammonia in the under-pressure carburizing cycle
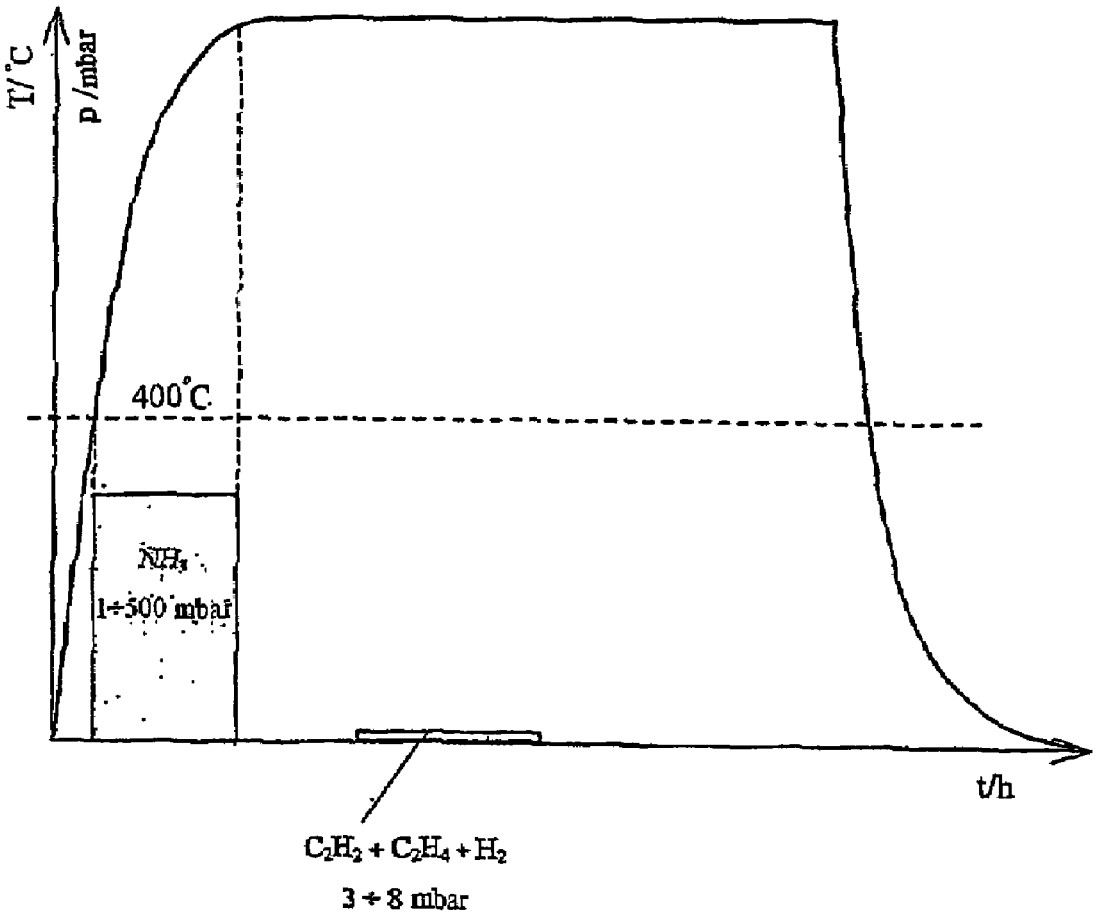

METHOD FOR UNDER-PRESSURE CARBURIZING OF STEEL WORKPIECES

This Application is a National Stage of Application No. PCT/PL03/000065 filed Jul. 2, 2003, which claims benefit of Polish Patent Application No. 356921 filed Oct. 31, 2002. The entire disclosure of the prior application is hereby incorporated by reference herein in its entirety.

The object of this invention relates to the method for carburizing of steel products, mainly parts of machines, vehicles and all types of mechanical apparatuses, in vacuum furnaces under reduced pressure and elevated temperature.

A method for carburizing of products made of steel in a furnace chamber is known from the U.S. Pat. No. 6,187,111. In this method, vacuum in the range of 1 to 10 hPa is generated and the temperature of the carburizing process is maintained between 900° C. and 1100° C. The carbon carrier there is gaseous ethylene. Another U.S. Pat No. 5,205,873, describes the carburizing process carried out under low pressure in a furnace chamber heated up to temperatures between 820° C. and 1100° C. This process starts in a chamber where an initial vacuum up to $10^{-1}$ hPa was generated to remove the air. Then, after backfill of the chamber with pure nitrogen, workpieces to be carburized are placed into it. In the loaded chamber, a vacuum in the range of $10^{-2}$ hPa is generated and the charge is heated up to the austenitizing temperature and this temperature is maintained until the temperatures across the workpiece are equalised; afterwards the furnace chamber is backfilled with hydrogen up to 500 hPa. Then ethylene as the carbon carrier is introduced under the pressure from 10 to 100 hPa and a gas mixture consisting of hydrogen and ethylene is created, in which the ethylene content ranges from 2% to 60% of the gas mixture by volume.

Also the U.S. Pat. No. 5,702,540, describes the method of carburizing, according to which the charge is pre-heated under vacuum and gaseous unsaturated aliphatic hydrocarbons are used as the carbon carrier. This method can also be applied for carbonitriding, where together with the carbon carrier an active nitrogen carrier is introduced to the furnace chamber.

The method for under-pressure carburizing of steel workpieces according to the present invention consists in the introduction of ammonia into a vacuum furnace chamber at the moment when the charge reaches the temperature of 400° C. and it is introduced into the vacuum furnace chamber until the charge reaches the temperature required for start of the carburizing process, which is the moment when the carbon carrier is started to be introduced.

The FIGURE. of the present application describes metering ammonia in the under-pressure carburization.

The method according to the present invention is distinguished by a possibility of an effective application of the upper range of carburizing temperatures due to restraining the growth of austenite grains as a result of initial saturation of the surface area with nitrogen, without the formation of unfavorable nitrides on the charge surface, and in consequence the process is significantly accelerated.

One of possible implementations of the method for under-pressure carburizing of steel workpieces according to the present invention is illustrated by the following examples:

EXAMPLE 1

A furnace chamber of the size 200×200×400 mm was loaded with workpieces made of low carbon steel grades C15, 16CrMn5 and 17CrNiMo. The total surface area of the charge was 0.4 $m^2$. After pre-heating under vacuum up to 400° C.

ammonia was introduced to the furnace chamber interior with a constant flow rate of 50 l/hr. The process atmosphere was maintained under a constant pressure of 5 mbar. When steel workpieces had reached the temperature of 950° C., the introduction of ammonia was interrupted, and carburizing atmosphere was introduced for twenty minutes and a constant temperature of the vacuum furnace chamber was maintained; the atmosphere was made up of the carbon carrier in the form of a mixture of ethylene and acetylene in the volume ratio 1, mixed with hydrogen in the volume ratio 1.17, introduced with a constant flow rate 190 l/hr and thus generating pressure pulse in the furnace chamber within the range of 3 to 8 mbar. For the next 8 minutes steel workpieces were heated under vacuum at the temperature of 950° C. and then slowly cooled under vacuum down to the ambient temperature. On individual steel workpieces carburized layers were produced with the following performance.

| Steel grade | Surface carbon concentration [%] | Case depth to limit structure-50% perlite + 50% austenite [mm] | Original grain size [mm] |
|---|---|---|---|
| C15 | 0.65 | 0.40 ± 0.005 | 40%-0.008<br>60%-0.011 |
| 16CrMn5 | 0.71 | 0.46 ± 0.005 | 50%-0.011<br>50%-0.013 |
| 17CrNiMo | 0.72 | 0.47 ± 0.005 | 70%-0.011<br>300%-0.016 |

The surface of all workpieces after carburizing was clean and bright without any evidence of soot and tar.

EXAMPLE 2

A furnace chamber of the size 200×200×400 mm was loaded with workpieces made of low carbon steel grades 16CrMn5 and 17CrNiMo. The total surface area of the load was 0.4 $m^2$. After pre-heating under vacuum up to 400° C. ammonia was introduced to the furnace chamber interior with a constant flow rate of 50 l/hr. The process atmosphere was maintained under a constant pressure of 5 mbar. When steel workpieces had reached the temperature of 950° C., the introduction of ammonia was interrupted, and carburizing atmosphere was introduced for twenty minutes and a constant temperature of the vacuum furnace chamber was maintained; the atmosphere was made up of the carbon carrier in the form of a mixture of ethylene and acetylene in the volume ratio 1, mixed with hydrogen in the volume ratio 1.17 introduced with a constant flow rate 190 l/hr and thus generating pressure pulse in the furnace chamber within the range of 3 to 8 mbar.

For the next 20 minutes steel workpieces were heated under vacuum at the temperature of 950° C. and then fast cooled down to the ambient temperature under nitrogen at the pressure increased up to 6 bar. On individual steel workpieces carburized layers were produced with the following performance.

| Steel grade | Surface hardness [$HV_{01}$] | Case depth to limit hardness 500 $HV_{01}$ |
|---|---|---|
| 16CrMn5 | 744 | 0.48 ± 0.005 |
| 17CrNiMo | 820 | 0.49 ± 0.005 |

The surface of all workpieces after carburizing was clean and bright without any evidence of soot and tar.

EXAMPLE 3

A furnace chamber of the size 200×200×400 mm was loaded with workpieces made of low carbon steel grades C15, 16CrMn5 and 17CrNiMo. The total surface area of the load was 0.4 $m^2$. After pre-heating under vacuum up to 400° C. ammonia was introduced to the furnace chamber interior with a constant flow rate of 50 l/hr. The process atmosphere was maintained under a constant pressure of 5 mbar. When steel workpieces had reached the temperature of 1000° C., the introduction of ammonia was interrupted, and carburizing atmosphere was introduced for twenty minutes and a constant temperature of the vacuum furnace chamber was maintained; the atmosphere was made up of the carbon carrier in the form of a mixture of ethylene and acetylene in the volume ratio 1, mixed with hydrogen in the volume ratio 1.17 introduced with a constant flow rate 270 l/hr and thus generating pressure pulse in the furnace chamber within the range of 3 to 8 mbar. For the next five minutes steel workpieces were heated under vacuum at the temperature of 1000° C. and then slowly cooled under vacuum down to the ambient temperature. On individual steel workpieces carburized layers were produced with the following performance.

| Steel grade | Surface carbon concentration [%] | Case depth to limit structure-50% perlite + 50% austenite [mm] | Original grain size [mm] |
|---|---|---|---|
| C15 | 0.66 | 0.52 ± 0.005 | 70%-0.011<br>30%-0.013 |
| l6CrMn5 | 0.70 | 0.58 ± 0.005 | 50%-0.013<br>50%-0.016 |
| 17CrNiMo | 0.70 | 0.59 ± 0.005 | 60%-0.013<br>40%-0.016 |

The surface of all workpieces after carburizing was clean and bright without any evidence of soot and tar.

The invention claimed is:

1. A method for under-pressure carburizing of at least one steel workpiece in a vacuum furnace chamber comprising:

introducing a charge comprised of at least one steel workpiece into the vacuum furnace chamber;

preheating the charge and, when the temperature of the charge reaches 400° C., introducing an active nitrogen carrier into the vacuum furnace chamber;

continuing the introducing of the active nitrogen carrier and the preheating until the temperature of the charge reaches a carburizing temperature and the pressure in the vacuum furnace chamber is at 1 to 500 mbar, and when the charge reaches the carburizing temperature, stopping the introducing of the active nitrogen carrier and starting the introducing of a carbon carrier into the vacuum furnace chamber; and effecting the carburizing of the at least one steel workpiece.

2. The method of claim 1, wherein the active nitrogen carrier is introduced to the furnace chamber in a continuous or pulse manner.

3. The method of claim 1, wherein the active nitrogen carrier is ammonia.

4. The method of claim 1, wherein the carbon carrier comprises a mixture of acetylene and ethylene.

5. The method of claim 1, wherein the carburizing temperature is at least 950° C.

* * * * *